US007084836B2

(12) United States Patent
Espenscheid et al.

(10) Patent No.: US 7,084,836 B2
(45) Date of Patent: Aug. 1, 2006

(54) FLAT PANEL ANTENNA ARRAY

(76) Inventors: Mark W. Espenscheid, 824 N. Roy Ave., North Lake, IL (US) 60164; Robert J. Gavrick, 910 S. Michigan, Chicago, IL (US) 60605

( * ) Notice: Subject to any disclaimer, the term of this patent is extended or adjusted under 35 U.S.C. 154(b) by 0 days.

(21) Appl. No.: 10/773,893

(22) Filed: Feb. 5, 2004

(65) Prior Publication Data

US 2004/0233122 A1 Nov. 25, 2004

Related U.S. Application Data

(60) Provisional application No. 60/470,785, filed on May 15, 2003.

(51) Int. Cl.
*H01Q 15/14* (2006.01)

(52) U.S. Cl. ..... 343/914; 343/912; 343/840

(58) Field of Classification Search ..... 343/912, 343/914, 840, 753, 755
See application file for complete search history.

(56) References Cited

U.S. PATENT DOCUMENTS

| | | | | |
|---|---|---|---|---|
| 2,547,416 | A | 4/1951 | Skellett | |
| 2,599,763 | A | 6/1952 | Kock | |
| 2,617,030 | A | 11/1952 | Rust et al. | |
| 2,640,154 | A | 5/1953 | Kock | |
| 4,513,293 | A | 4/1985 | Stephens | |
| 4,804,970 | A | 2/1989 | Todd | |
| 4,825,223 | A * | 4/1989 | Moore | 343/840 |
| 5,283,591 | A | 2/1994 | Delmas | |
| 5,486,950 | A | 1/1996 | Collinge | |
| 5,512,913 | A | 4/1996 | Staney | |
| 5,606,334 | A * | 2/1997 | Amarillas et al. | 343/840 |
| 5,675,349 | A | 10/1997 | Wong | |
| 6,281,852 | B1 * | 8/2001 | Amarillas | 343/725 |
| 6,473,049 | B1 | 10/2002 | Takeuchi et al. | |

* cited by examiner

*Primary Examiner*—Hoang V. Nguyen

(57) ABSTRACT

A flat plate reflective assembly for receiving and focusing incident microwave signals having a wavelength (λ), comprising a series of adjacent reflecting surfaces, each having a separate focal points offset from one another in focal length by one wavelength or a multiple of the wavelength. When an incident microwave signal strikes the reflective assembly, each reflected wave is directed to the focal point for the respective reflecting surface and is collected by the LNB. Each reflected wave arrives at the focal point for the reflecting surface in-phase with other reflected radiation. However, spatial resolution of the focal points reduces the deconstructive interferences between the reflected radiation. In another embodiment, the flat plate reflective assembly is configured is configured to reflect incident radiation in-phase such that microwave signals reflected by each reflective surface arrive at a common focal point in-phase.

19 Claims, 13 Drawing Sheets

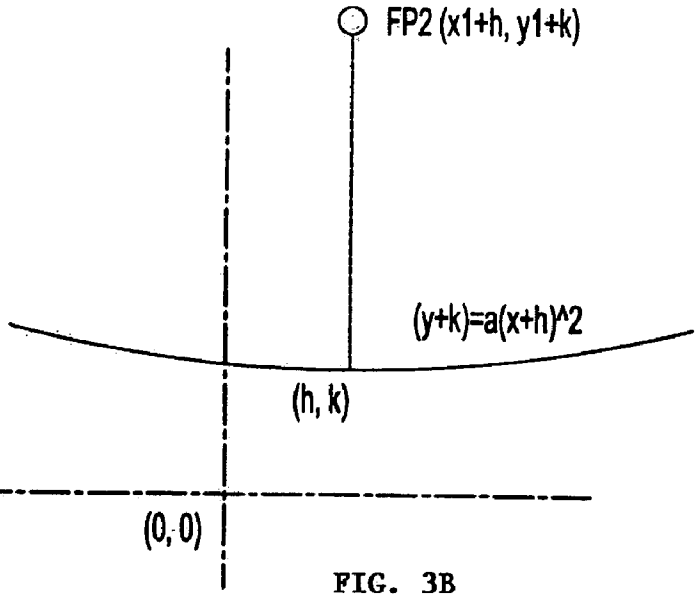
FIG. 3B
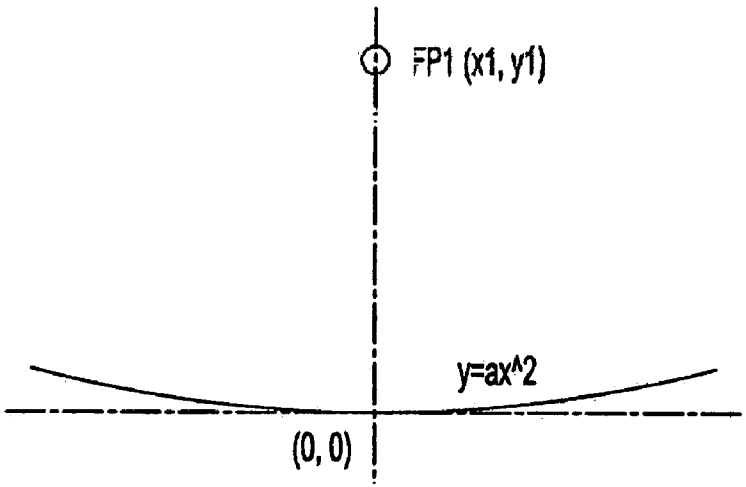
FIG. 3A
Fig-3

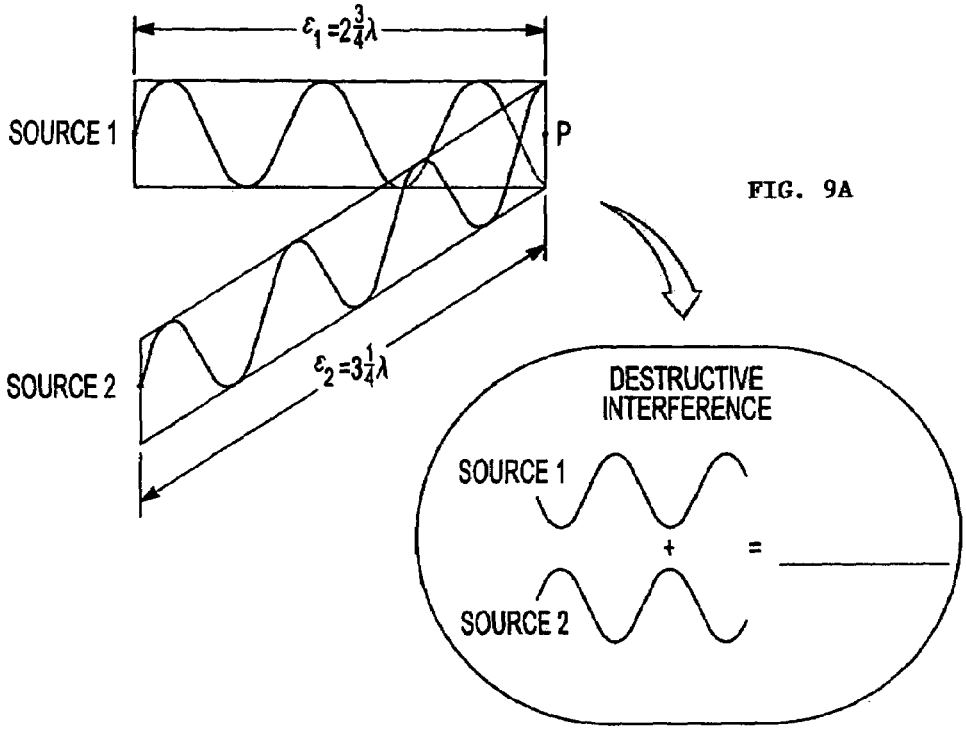
FIG. 9A
FIG. 9B
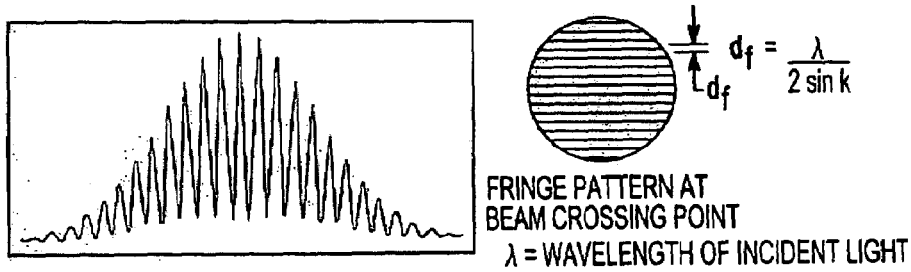
FIG. 10

FLAT PANEL ANTENNA ARRAY

CROSS-REFERENCE

This application claims priority to the Provisional Patent Application, Application No. 60/470,785 filed on May 15, 2003, entitled Flat Panel Antenna Array.

FIELD OF THE INVENTION

The present invention relates to a reflective assembly for receiving and focusing incident microwave frequencies. More particularly, the present invention relates to a flat panel array antenna including a series of adjacent reflecting surfaces offset in focal length by a multiple of wavelength, lambda (λ), and each reflective surface having a different focal point.

BACKGROUND OF THE INVENTION

Stepped or flat reflective antenna assemblies are known. These assemblies typically include a series of common parabolic array surfaces rotated about a common axis, each array in the series having a common focal point. These assemblies reduce stray noise interference by stepping the reflective surfaces comprising the assembly by wavelength or multiples of ½ wavelengths.

There is needed, however, a parabolic array that maintains wavelength spacing between adjacent reflective surfaces that have different focal points. Focal point separation can be utilized not only for reduction in overall array size, but to provide for a reduction in wave interaction between reflective radiation from adjacent surfaces.

SUMMARY OF THE INVENTION

The present invention is directed to a reflective assembly such as a flat panel antenna array for reflecting or receiving incident microwave frequencies. A reflective assembly for use in an antenna for receiving incident microwave signals, comprising a first reflective surface; a plurality of reflective surfaces positioned successively adjacent the first reflective surface, each said reflective surface being at least a portion of a concave or convex surface, each reflective surface having a focal point and focal length relative to the first reflective surface, wherein one or more of the reflective surfaces are translated about one or more common axes, resulting in an offset of the focal point of one or more of the reflective surfaces relative to that of the first reflective surface, whereby the microwave signals reflected by each reflective surface arrive at the focal point for the reflecting surface in-phase with the microwave signals reflected by the remaining reflective surfaces.

Each reflective surface may have a depth adjusted to nλ or nλ/2. Each reflective surface also provides different focal points in-phase with adjacent surfaces, with focal length separation positioned at wavelength spacing or multiples of wavelength spacing.

In order to separate the focal points from adjacent surfaces, yet maintain focal length spacing, reflective surfaces are translated from a common axis. Parabolic reflective surfaces have a reflection plane about a common axis. The parabolic array can be translated as an entity about a common point, or each differently about the common axis of reflection.

Translation of an array about a common axis shifts the focal point but maintains the focal length. Translating the array about a common axis differently on either side of the common axis separates the parabolic surface into to distinct surfaces, each having a different focal point. Translation of parabolas about a common axis can be utilized to separate the interaction between reflected radiation of adjacent reflective surfaces and alter array size.

BRIEF DESCRIPTION OF THE DRAWINGS

The features and inventive aspects of the present invention will become more apparent upon reading the following detailed description, claims, and drawings, of which the following is a brief description:

FIGS. 3A–B illustrate the translation of one of the reflective surfaces shown in FIG. 2 about a common axis.

FIGS. 7A–B show truncation of the parabolic surfaces shown in FIG. 1, wherein FIG. 7A shows the reflective surfaces having a spacing of λ/2 and FIG. 7B shows full wavelength between the reflective surfaces.

FIGS. 9A–B illustrate deconstructive interference between reflected radiation.

FIG. 10 shows the interference pattern that occurs a result of interference between reflected radiation.

DETAILED DESCRIPTION OF THE INVENTION

As required, detailed embodiments of the present invention are disclosed herein; however, it is to understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Additionally, the detailed is description is described with reference to the accompanying drawing figures. Terms of reference such as "top," "bottom," "upper," or "central" are used to facilitate an understanding of the present invention in view of the accompanying figures. The identified reference terms or other similar terms are not intended to be limiting, and one of ordinary skill in the art will recognize that the present invention may be practiced in a variety of spatial orientations without departing from the spirit and scope of the invention.

Figure 2:
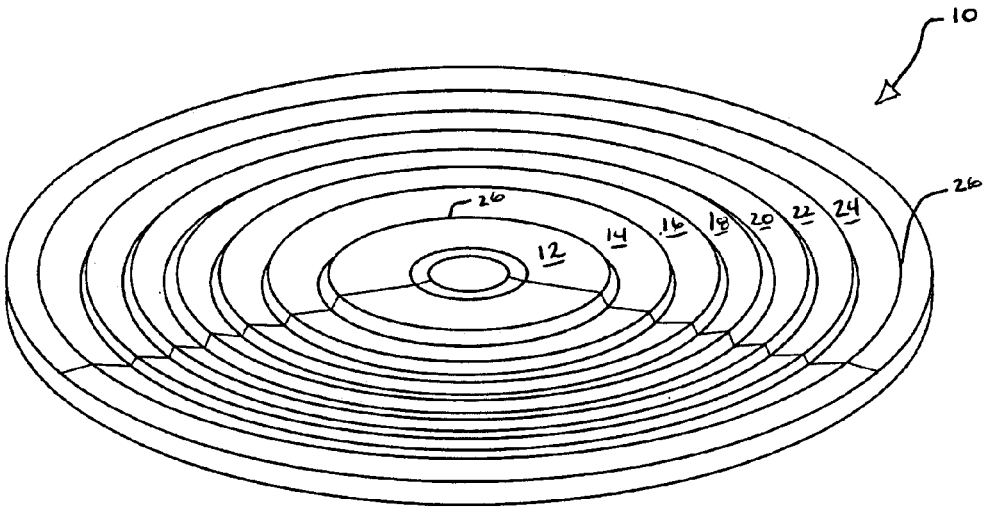
FIG. 2 is a perspective view of a reflective assembly formed in accordance with the teachings of the present invention.

The present invention, as shown in FIG. 2, relates generally to a flat panel reflective assembly 10. The reflective assembly includes a plurality of reflective surfaces 12–24, each providing a different or distinct focal point. The radiation reflected by each reflective surface 12–24 is received in-phase at the focal point for the reflecting surface. Separation of the focal points help to minimize interference between reflected radiation. Additionally, the present invention permits a reflective assembly that may be used to focus similar or different wavelengths simultaneously.

In order to fully describe a reflective assembly 10 formed in accordance with the teachings of this invention, several parameters such as focal point spacing, depth of the reflective surfaces 12–24 and focal length spacing must be derived or determined. The following equations describe one way of determining each of these parameters.

The general equation for a parabola is given by Equations (1) and (2). The particular equation chosen depends on whether the parabola opens upwards (y-direction) or outwards (x-direction):

$$y^2=4px \text{ (parabola opening in x-direction in an x-y coordinate system)} \quad (1)$$

$$x^2=4py \quad (2)$$

In both equations, the (x, y) coordinates are related to a constant p, the focal length of the parabola.

It is known that a series of parabolas may be generated with the same focal point if they are related by a shift in vertices. U.S. Pat. No. 4,825,223 issued to Moore on Apr. 25, 1989, and incorporated herein by this reference (hereinafter the "Moore patent") demonstrates this principle for a series of parabolas spaced at λ/2. Equation (3) defines a series of reflective surfaces having the same focal point and which are capable of reflecting incident radiation in phase as taught by Moore.

$$y^2=4(p+n\lambda/2)x, \text{ where } n=0,1,2,3, \ldots \quad (3)$$

Figure 1:
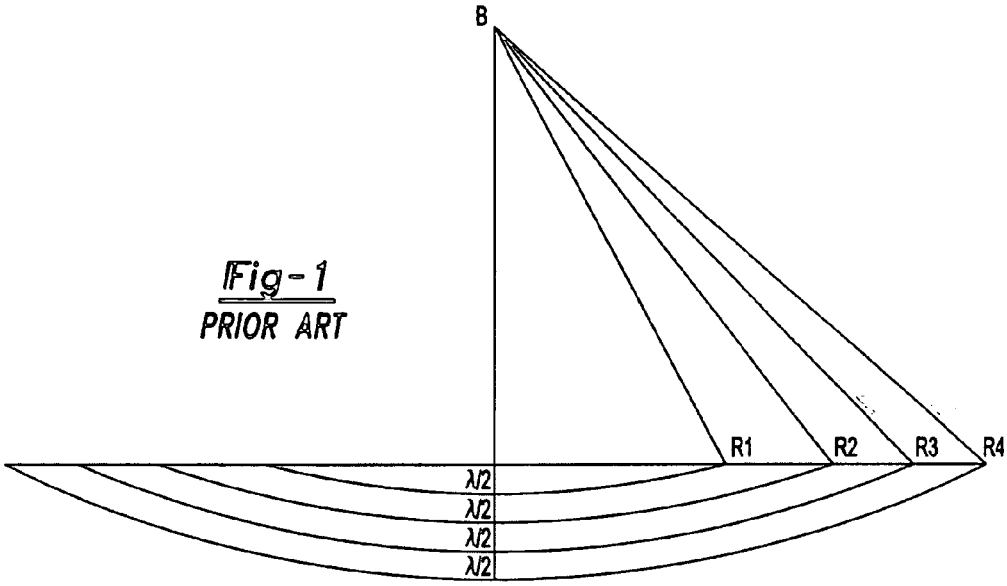
Fig-1 PRIOR ART
FIG. 1 is section view of a prior art reflective antenna.

This series of parabolas generated by Equation (3) has the same focal point but the depth of adjacent parabolas is larger or smaller by λ/2. FIG. 1 shows a series of parabolic surfaces generated according to the teachings of the Moore patent. The incident radiation reflected by the family of reflective surfaces defined by Equation (3) and shown in FIG. 1 is reflected to a common focal point, and the reflected radiation is in phase.

In the current invention, adjacent reflective surfaces are separated by wavelength spacing, with focal points separated by translation of the vertices about a common axis, as best seen in FIGS. 3 and 4. Equation (4) (fundamental Equation for a Parabola) provides a basis for determining translation parameters.

$$Y=AX^2+b. \quad (4)$$

Equation (4) describes a series of parabolic curves having vertices at (0, b). This equation describes a series of reflective surfaces, preferably parabolic surfaces, that at any distance X away from the vertex has a common Y value, producing a mirror image about the X=0 axis.

Equation (5) defines a series of parabolas having a common focal point. For example, the series may include vertices at λ/2 spacing with focal lengths at wavelength spacing. As defined by Equation (5), this family of parabolas may be centered at vertices (0, nb). Essentially, Equation (5) permits a series of common focal point parabolic surfaces (FIG. 1) to be translated about a common axis as previously described with reference to FIG. 4B.

$$Y_n=aX^2+nb \quad n=0, 1, 2, 3, \ldots \quad b=\tfrac{1}{2}\lambda \quad (5)$$

The reflective assembly defined by Equation (5) may be translated spatially by a position (h, k) according to Equation 6 (Translation of a Parabola).

$$Y=aX^2+nb \text{ by } (h, k)$$

$$(Y_n-h)=a(X-k)^2+nb$$

$$Y_n=aX^2-2akX+ak^2+nb+h \quad (6)$$

Equation (6) describes a series of parabolas that are translated point for point from that described in Equation (4) by a value of (h, k). FIGS. 3A and 3B illustrate the translation of a parabolic surface according to Equation (6). As shown in FIG. 3B, the focal length of the translated parabola remains constant, yet the parabola's vertex and focal point have been translated by (h, k).

Using Equation (6), a series of parabolas can be described that are offset by wavelength spacing with vertices translated by λ/2 and focal lengths related by full wavelength spacing. Thus, translating a series of parabolas by (h, k) according to Equation (6) changes the spatial position of the vertices but the focal points of the adjacent parabolas remain constant.

Figure 4B:
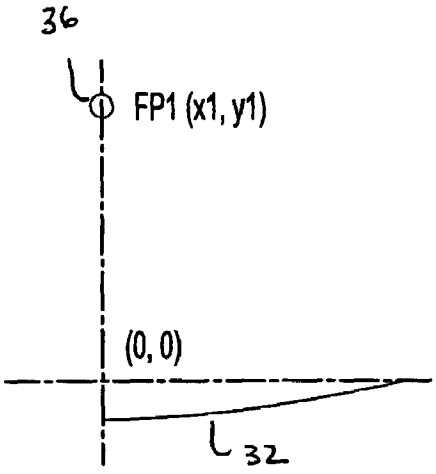
FIGS. 4A–C show the separation and translation of one of the reflective surfaces shown in FIG. 2 along with the focal point for the respective surface about the X and Y axes.
Figure 4A:
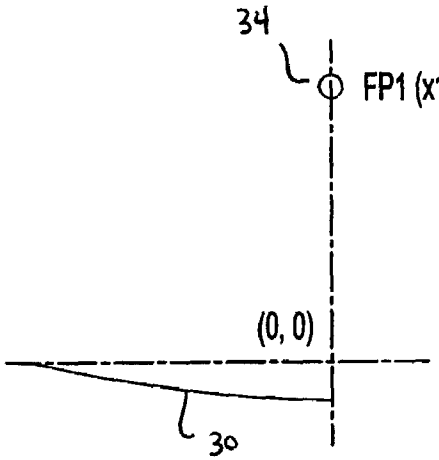
Figure 4A:
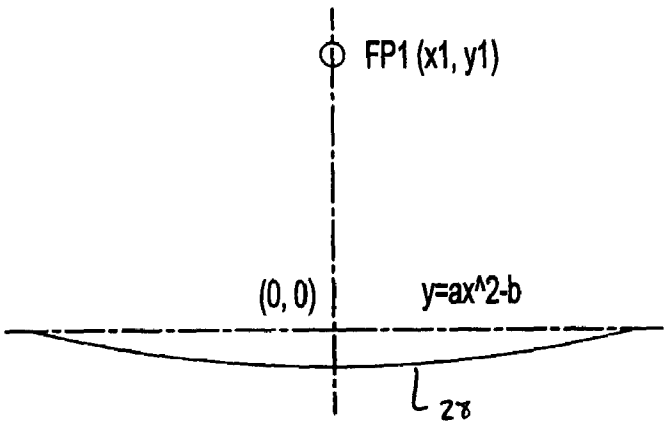
Figure 4C:
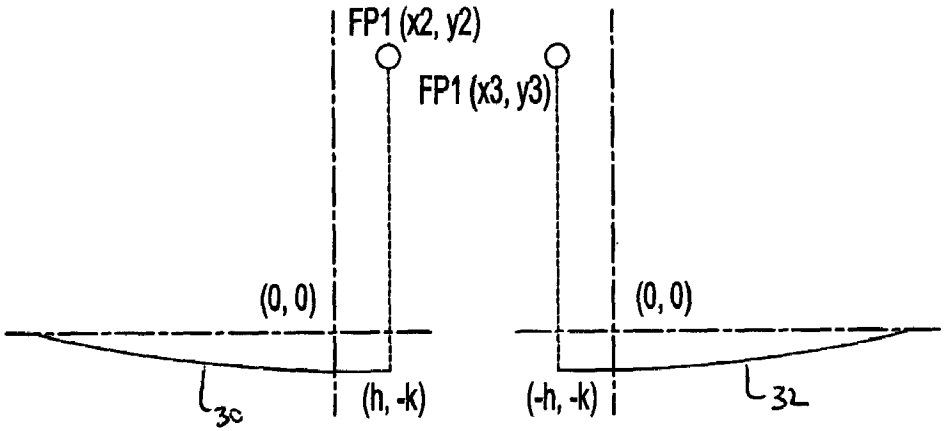

If the series of parabolas described in Equation (6) is separated about their respective vertices, each parabolic segment may be translated as a mirror image, as best seen in FIGS. 4B–4C. For example, the parabola 28 shown in FIG. 4A is split at its vertex to obtain the parabolic sections 30, 32 shown in FIG. 4B.

The parabolic sections 30, 32 may be obtained by splitting the parabola 28 at its center or at any point to the right or left of center. Splitting the parabola 28 into sections 30, 32 results in the creation of two distinct focal points 34, 36 that are associated with sections 30 and 32 respectively. Thus, separating a parabola about its vertex may result in spatial resolution of the focal points, yet maintain focal point spacing of multiples of the wavelength. Spatial resolution may also be utilized to decrease the sensitivity of the collector (low noise band filter or "LNB") to spatial movement. Conventional parabolic dishes for the C-band have a focal point tolerance of about ±0.75" from focus. The current invention as described provides little signal difference with movement of the LNB collector by as much as ±1.5 inch focus.

The parabolic sections 30, 32 may be configured so that their respective slopes remain equal. However, the slopes may be varied as necessary to achieve the desired signal reception. For example, the slope of section 28 may be set at 2° and the slope of section 30 may be set at 9°. Once the sections 30, 32 are recombined, for example, through a metal stamping process, the new parabolic surface may be capable of reflecting radiation at different wavelengths.

The parabolic sections 30, 32 of FIG. 4B are translated about the X-Y axis to obtain the shifted parabolic sections shown in FIG. 4C. This shift about the X-Y axis helps to minimize nonparallel light interaction as will be discussed later with reference to FIGS. 10 and 12. It will be appreciated that one or more of the reflective surfaces 14–24 may be shifted according to FIG. 4C, while unshifted reflective surfaces maintain their vertex centered at (0, 0).

Equations (7) (Translation of One Side of the Parabolic Curve for all X Values Less than (the Vertex (X, b)) and (8) (Translation of One Side of the Parabolic Curve for all X Values Greater than the Vertex (X, b)) describe a series of parabolas, translated about their respective vertices by (h, ±k). FIGS. 3B and 4C show the translation of parabolic curves defined by Equations (7) and (8), respectively.

$$Y_n = aX^2 - 2akX + ak^2 + nb + h \quad n=0, 1,2,3, \ldots \quad X<(\text{vertex } (X,b)) \tag{7}$$

$$Y_n = aX^2 + 2akX + ak^2 + nb + h \quad n=0, 1,2,3, \ldots \quad X>(\text{vertex } (X, b)) \tag{8}$$

The focal points for the curves described in Equations (7) and (8), maintain focal point spacing in phase, yet the focal points from adjacent parabolas may be shifted away from a common focal point. The extent of focal point shift as well as the relative spatial position of the vertices and focal points may be arranged spatially by changing values of h and k for each parabola.

Equation (9) (Series of related curves shifted by different (h, k) values) defines a series of parabolic curves shifted by (h, k).

$$Y_n = aX^2 \pm 2ak_nX + ak^2 + nb + h_n \quad n=0, 1,2,3, \ldots \quad X>(\text{vertex } (X, b)) \tag{9}$$

For each parabola in the series defined by Equation (9), the absolute values for the (h, k) shift may be changed as described by Equation (9). The absolute values of ($h_n$, $k_n$) may be varied to spatially position the vertices of each segment of the parabola as well as each member of the series of parabolas. Although a series of parabolas with common a-values and mirror image shifts of (h, k) have been described, one of ordinary skill in the art would understand that combinations of differing a-values as well as differing ($h_n$, $k_n$) shifts, both on either side of a parabola as well as within the series of parabolas, could be generated to maintain desired spacing.

The shift of vertices and focal point separation between adjacent parabolas may be utilized to modify the size and reflective properties of a series of reflective surfaces. Gain may be achieved by providing multiple reflective surfaces, which reflect incident radiation, and the reflected radiation arrives in-phase at the respective focal points for the reflective surfaces.

Figure 5A:
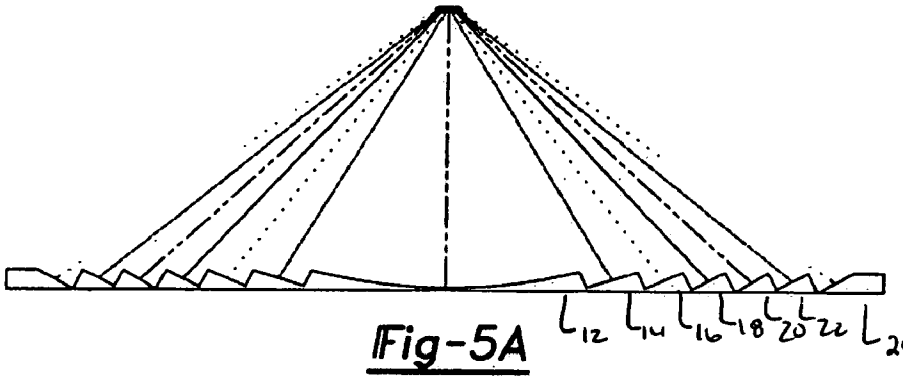
FIGS. 5A–B show translation of the reflective surfaces shown in FIG. 2, resulting in focal point separation along the X-axis.
Figure 5B:
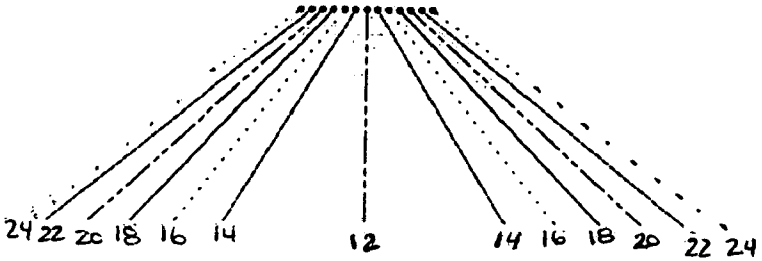
Figure 5C:
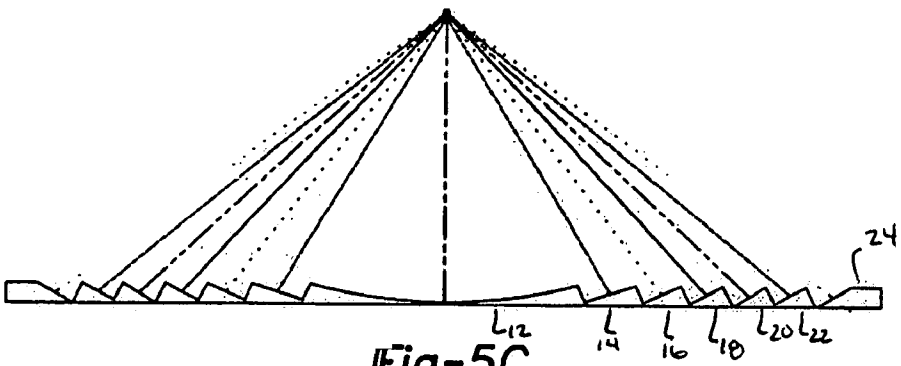
FIGS. 5C–D show translation of the reflective surfaces shown in FIG. 2, resulting in focal point separation along the Y-axis.
Figure 5D:
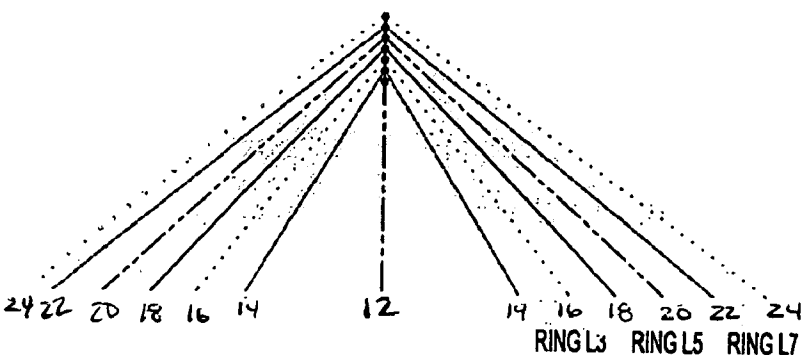
Figure 6A:
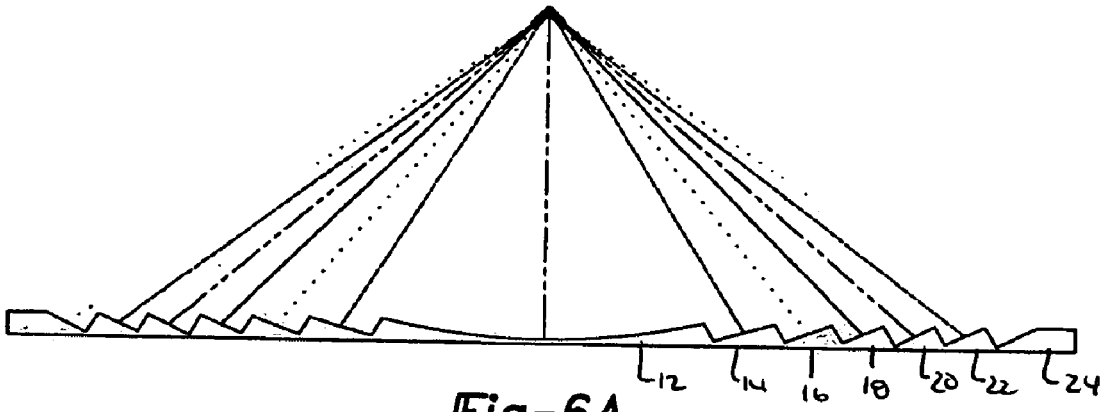
FIGS. 6A–B show translation of the reflective surfaces shown in FIG. 2, resulting in focal point separation about both the X and Y-axes.
Figure 6B:
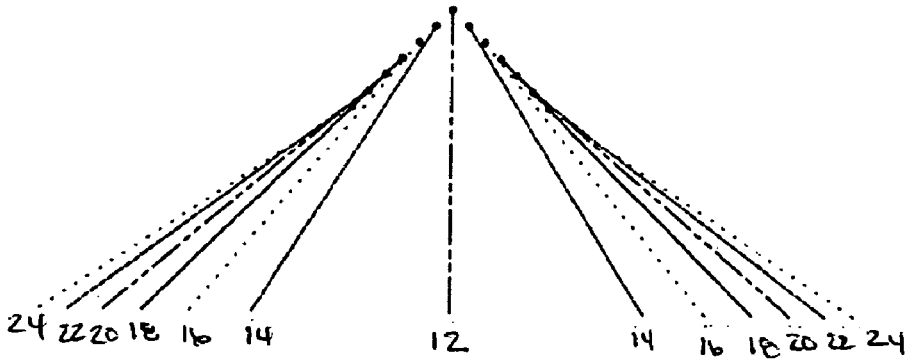

FIGS. 5 and 6 show a series of parabolic surfaces that have been translated around a common axis. Each parabolic surface in the series has a common slope, the a-value shown in Equation (9). For example, FIG. 5A shows translation of the parabolic surfaces 14–24 in the X-direction, resulting in a flat or horizontal focal point spacing. This configuration may reduce deconstructive interference, which will be discussed below with reference to FIGS. 9A–B, 10 and 11. FIG. 5B shows an extended version of the focal point spacing shown in FIG. 5A. FIG. 5C shows the focal point spacing for reflective surfaces 14–24 that have been translated in the Y-direction only. FIG. 5D shows an extended version of the focal point spacing shown in FIG. 5C. FIGS. 6A and B illustrate focal point spacing, wherein the reflective surfaces 14–24 have been translated in both the X and Y directions. The related reflective surfaces shown in FIGS. 5A–D and FIGS. 6A–B, respectively, may have focal point spacing at a single wavelength or at a multiple of a common wavelength to provide gain.

Figure 8:
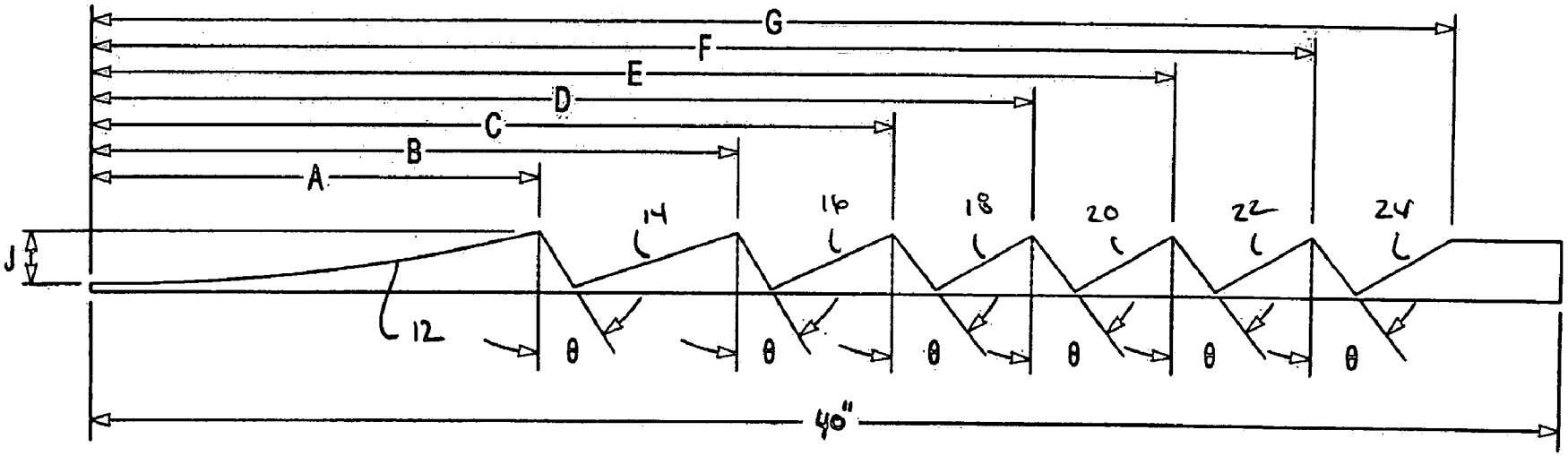
FIG. 8 shows an example of the reflective assembly shown in FIG. 2, wherein the reflective assembly has been cut into a square cross-section.

With reference to the following drawings, an exemplary embodiment of the invention will be explained. FIGS. 2 and 8 show a reflective assembly 10 formed in accordance with the teachings of the present invention. As shown in FIG. 2, the reflective assembly 10 includes a central parabolic reflective surface 12.

The reflective assembly 10 further includes a plurality of adjacent parabolic reflective surfaces 14–24. As best seen in FIGS. 2 and 8, each reflective surface 12–24 may be spaced so that respective surface ridges 26 are parallel. This arrangement provides a reflective assembly having adjacent reflective surfaces located in a common plane.

The spacing between immediately adjacent reflective surfaces 12–24 may be one full wavelength (λ) or multiples of wavelength (λ) spacing, the spacing being measured relative to the focal point of reflective surface 12. In an illustrative embodiment, the spacing between reflective surfaces 12–24 is set to provide one wavelength (λ) spacing on the focal lengths and λ/2 separation at the focal points.

All reflective surfaces 12–24 face a common direction and are translated about a common axis; however, each reflective surface defines separate focal points, resulting in multiple focal points for the reflective assembly 10 (see FIGS. 5A–D and 6A–B). As illustrated, the focal point spacing for the reflective surfaces 14–24 is spatially resolved away from the focal point for reflective surface 12, and the spacing between the reflective surfaces 12–24 is provided within a 2.4 inch by 2.4 inch pattern.

Each reflective surface 12–24 reflects all incoming incident radiation. The radiation reflected by the reflective assembly 10 is directed in-phase to the focal point determined for the respective reflecting surface. To achieve this effect, each reflective surface 14–24 and its focal point are translated around a common axis (see FIGS. 5A–D and FIGS. 6A–B). However, reflective surface 12 remains centered at (0,0) on the X–Y axis. The translation of the reflective surfaces 14–24 is best illustrated by the translation of a single reflective surface as shown in FIG. 3.

The depth of each reflective surface may be constant over the entire surface of the reflective assembly 10. That is, each reflective surface 12–24 may have a depth that is offset by the same "J" dimension (see FIG. 8). For example, the depth of each reflective surface 12–24 may be set at or about 1.6 inches (1.6 represents the value of λ/2 at 3.9 GHz) relative to the center of the center reflective surface 12. The J-dimension may be centered at 3.9 GHz, and may vary depending on the frequency of incident radiation.

Alternatively, the "J" dimension may be varied from reflective surface to reflective surface, resulting in a non-planar array. However, in order to maintain desired focal point separation in a non-planar array parameters such as depth, diameter and extent of translation of the reflecting surface may need to be altered to maintain reflected radiation in phase with adjacent surfaces. Thus, prior art devices of the type disclosed by the Moore patent and U.S. Pat. No. 5,512,913 issued to Staney on Apr. 30, 1996, incorporated herein by reference (hereinafter the "Staney patent"), may be modified in accordance with the teachings of the present invention to achieve a series of translated, multi-focal point non planar reflective assemblies that reduce interference between reflected radiation.

Referring back to FIG. 8, the angle (θ) is 30° relative to the Y-axis. The value of θ is selected to minimize side lobe radiation also known as deconstructive interference.

As shown in FIGS. 9A and 9B, deconstructive interference occurs when radiation enters the antenna off-axis and reflects off the surfaces of the shoulders of the reflective surfaces 12–24. As the reflected radiation approaches the respective focal points, the reflected radiation may deconstructively interfere with one another. FIG. 10 shows the signal pattern that may results as a result of crossing light waves.

Figure 11:
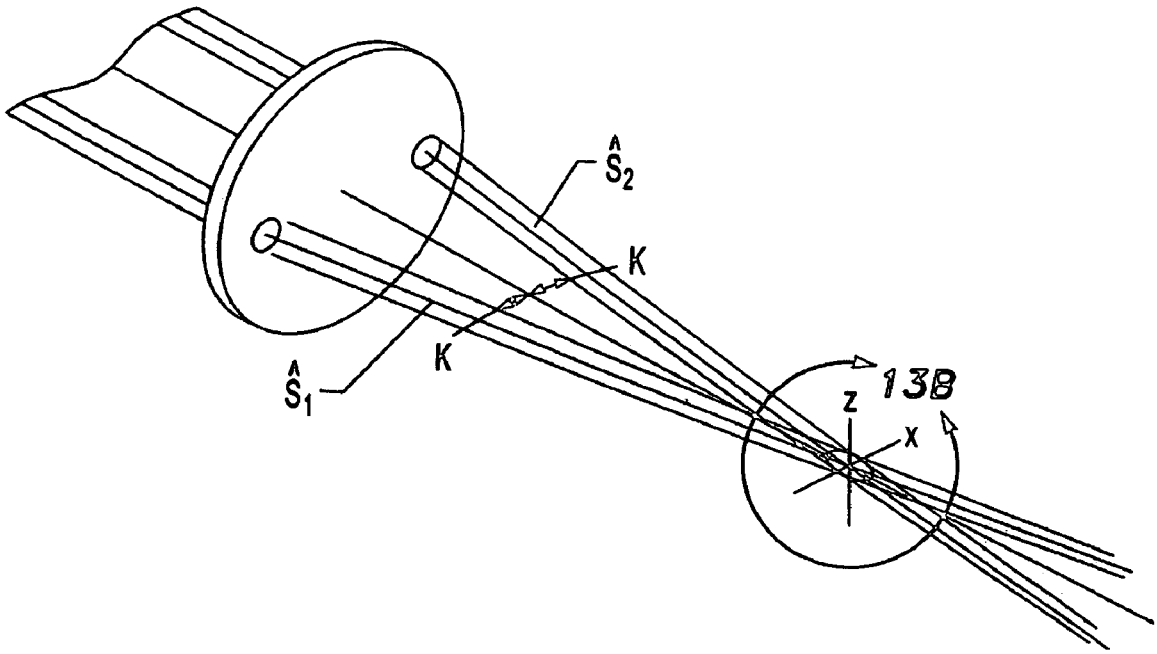
FIG. 11 shows deconstructive interference between radiation generated by a two column light source.

As shown in FIG. 11, if the reflected radiation from adjacent reflective surfaces is spatially separated by a shift in focal points, deconstructive interference may be reduced. For example, if focal points are spatially resolved, as shown in FIG. 11, the interaction of reflected radiation from adjacent reflective surfaces may be minimized. Focal point separation may be maximized depending on the scalar, feed horn and LBN utilized to minimize interaction of reflected radiation from adjacent reflective surfaces. Consequently, reducing deconstructive interference at the focal points may permit the production of a "cleaner" signal. Further, it is envisioned that the choice of parabolic spacing as well as position can be constructed so as to minimize interferences from stray radiation as well as minimize interferences from other wavelength radiation.

As best seen in FIG. 8, the overall diameter of the reflective assembly 10 may be approximately 80 inches based on a focal length of 1.6 inches centered at 3.9 GHz. However, one of ordinary skill in the art will appreciate that the physical dimensions and angular orientation of the reflective surfaces may vary depending on the frequency of incident radiation and choice of the designer.

FIGS. 5A–D, 6A–B and 8 illustrate a series of parabolic reflective surfaces focused at 3.95 GHz incident radiation having adjacent reflective surfaces offset in focal length by various multiples of the wavelength (λ). The focal length for each reflective surface is at the same point, but each reflective surface has a different focal length spacing. The focal length spacing for each reflective surface 12–24 is represented, respectively, by references A–G shown in FIGS. 6A–B and FIG. 8 represent the same reflective surfaces described in FIGS. 1 and 7A and 7B but with offset focal points. The illustrated parabolic curves shown in the FIGS. 6A–B and FIG. 8 are based on a central reflecting surface 12 having the same depth and diameter.

Figure 7A:
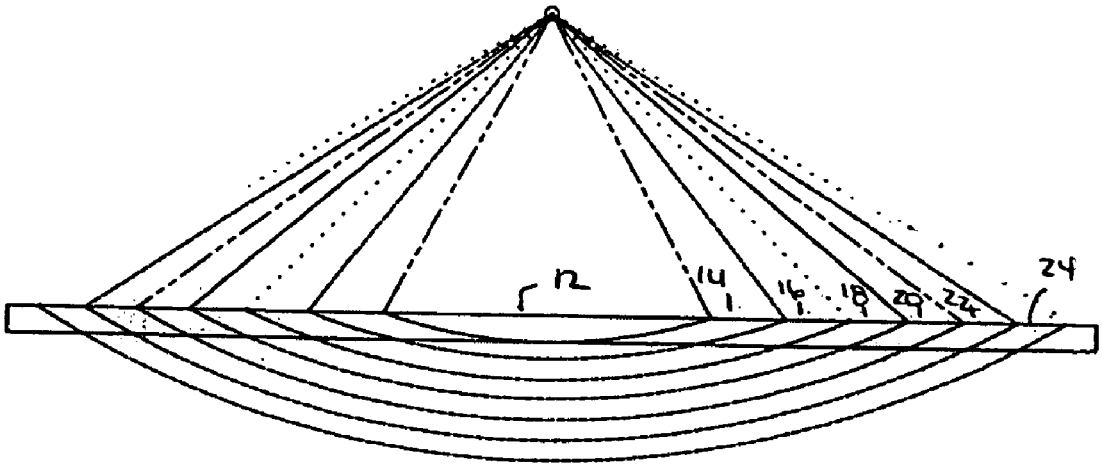

Tables 1 and 2 provide descriptive comparison of size and focal length conversions for several combinations of wavelength (λ) or λ/2 reflector assemblies. The reflective assembly illustrated in Table 1 reports determined values using Equation (5) for a reflective assembly having multiple focal points, and Table 2 reports determined values also using Equation (5) for a reflective assembly having a single common focal point. FIGS. 5C and 5D illustrate a series of parabolic curves that represent curves having the reported values, were n=1, 2, and 3. In the table $D_n$ represents the diameter of the reflective surface; $d_n$ represents the depth (dimension J shown in FIG. 8); and $F_L$ represents the focal length. Also note that the depth $d_n$ appears to vary through out the reflective assembly. The reported value is the depth for a non-truncated parabola of the type shown in FIG. 1. If the parabolas are truncated as shown in FIG. 7A and B, the depth ($d_n$) would be approximately 1.59 inches for each adjacent surface.

TABLE 1

Examples of Concentric Parabolic Rings with Different Focal Points

| Parabola # | Diameter ($D_n$- in) | Depth ($d_n$- in) | $F_L$ (in) | Delta $F_L$ | Focal Point (in) | Delta FP |
|---|---|---|---|---|---|---|
| | | Spacing at ½ Wavelength | | | | |
| 12 | 25.60 | 1.59 | 25.68 | | 24.09 | |
| 14 | 36.94 | 3.13* | 27.28 | 1.59 | 24.15 | 0.06 |
| 16 | 45.86 | 4.55* | 28.87 | 1.59 | 24.32 | 0.17 |
| 18 | 53.86 | 5.95* | 30.47 | 1.59 | 24.51 | 0.20 |
| 20 | 61.84 | 7.46* | 32.06 | 1.59 | 24.61 | 0.09 |
| 22 | 69.81 | 9.05* | 33.66 | 1.59 | 24.60 | 0.00 |
| 24 | 77.88 | 10.75* | 35.25 | 1.59 | 24.50 | −0.11 |
| | | Spacing at Full Wavelength | | | | |
| 12 | 25.60 | 1.59 | 25.68 | | 24.09 | |
| 14 | 36.94 | 2.95* | 28.87 | 3.19 | 25.92 | 1.83 |
| 16 | 45.86 | 4.10* | 32.06 | 3.19 | 27.96 | 2.04 |
| 18 | 53.86 | 5.14* | 35.25 | 3.19 | 30.11 | 2.15 |
| 20 | 61.84 | 6.22* | 38.44 | 3.19 | 32.22 | 2.12 |
| 22 | 69.81 | 7.32* | 41.63 | 3.19 | 34.31 | 2.09 |
| 24 | 77.88 | 8.46* | 44.82 | 3.19 | 36.36 | 2.05 |
| | | Spacing at 3/2 Wavelength | | | | |
| 12 | 25.60 | 1.59 | 25.68 | | 24.09 | |
| 14 | 36.94 | 2.80* | 30.47 | 4.78 | 27.67 | 3.58 |
| 16 | 45.86 | 3.73* | 35.25 | 4.78 | 31.52 | 3.86 |
| 18 | 53.86 | 4.53* | 40.04 | 4.78 | 35.51 | 3.99 |
| 20 | 61.84 | 5.33* | 44.82 | 4.78 | 39.49 | 3.98 |
| 22 | 69.81 | 6.14* | 49.61 | 4.78 | 43.46 | 3.98 |
| 24 | 77.88 | 6.97* | 54.39 | 4.78 | 47.42 | 3.96 |

TABLE 2

Examples of Concentric Parabolic Rings with Common Focal Points

| Parabola # | Diameter ($D_n$-in) | Depth ($d_n$-in) | $F_L$ (in) | Delta $F_L$ (in) | Focal Point (in) | Delta FP |
|---|---|---|---|---|---|---|
| | | Spacing at ½ Wavelength | | | | |
| 12 | 25.60 | 1.59 | 25.68 | | 24.09 | |
| 14 | 37.31 | 3.19 | 27.28 | 1.59 | 24.09 | 0.00 |
| 16 | 47.01 | 4.78 | 28.87 | 1.59 | 24.09 | 0.00 |
| 18 | 55.77 | 6.38 | 30.47 | 1.59 | 24.09 | 0.00 |
| 20 | 63.96 | 7.97 | 32.06 | 1.59 | 24.09 | 0.00 |
| 22 | 71.79 | 9.57 | 33.66 | 1.59 | 24.09 | 0.00 |
| 24 | 79.35 | 11.16 | 35.25 | 1.59 | 24.09 | 0.00 |
| | | Spacing at Full Wavelength | | | | |
| 12 | 25.60 | 1.59 | 25.68 | | 24.09 | |
| 14 | 47.01 | 4.78 | 28.87 | 3.19 | 24.09 | 0.00 |
| 16 | 63.96 | 7.97 | 32.06 | 3.19 | 24.09 | 0.00 |
| 18 | 79.35 | 11.16 | 35.25 | 3.19 | 24.09 | 0.00 |
| 20 | 93.96 | 14.35 | 38.44 | 3.19 | 24.09 | 0.00 |
| 22 | 108.10 | 17.54 | 41.63 | 3.19 | 24.09 | 0.00 |
| 24 | 121.94 | 20.73 | 44.82 | 3.19 | 24.09 | 0.00 |
| | | Spacing at 3/2 Wavelength | | | | |
| 12 | 25.60 | 1.59 | 25.68 | | 24.09 | |
| 14 | 55.77 | 6.38 | 30.47 | 4.78 | 24.09 | 0.00 |
| 16 | 79.35 | 11.16 | 35.25 | 4.78 | 24.09 | 0.00 |
| 18 | 101.08 | 15.95 | 40.04 | 4.78 | 24.09 | 0.00 |

TABLE 2-continued

| Examples of Concentric Parabolic Rings with Common Focal Points | | | | | | |
|---|---|---|---|---|---|---|
| 20 | 121.94 | 20.73 | 44.82 | 4.78 | 24.09 | 0.00 |
| 22 | 142.32 | 25.52 | 49.61 | 4.78 | 24.09 | 0.00 |
| 24 | 162.40 | 30.30 | 54.39 | 4.78 | 24.09 | 0.00 |

Scaling of reflective assembly type devices can be provided by scaling the overall dimension of the size of the reflective assembly itself or by the addition or removal or adjacent reflective surfaces. It is not necessary to just add or remove adjacent surfaces. It is expected that at least one pair of adjacent surfaces is required to demonstrate enhanced gain over a single parabolic reflector. As scaling in size occurs, the focal points and reflected radiation interaction may be adjusted by changing the adjacent ring or surface size while maintaining an in-phase reflection of adjacent surfaces. In addition, any frequencies at even multiples of wavelength or $\lambda/2$ may also be reflected. Thus, such devices may permit multi-wavelength reflection. For example, the Ku band frequencies around 12 GHz may also be collected in phase if the spacing is set at or near 4 GHz.

Spatial resolution of the satellites transmitting in the C-band in the Clark belt is at 2°. Resolution of the are is directly proportional to the size of the conventional parabolic reflecting dish. A 7.5' conventional C-band dish has a spatial resolution of about 2.7°, a 10' dish approximately 1.8°. At parabolic dish at 7' in diameter can receive an overlap signal from an adjacent satellite. This is demonstrated as a dual picture reception or interference. For example, through almost the complete are is available in the Illinois region of the U.S., little adjacent satellite signal is detected on a 5' square reflector in comparison to a 7' dish. For example, using a 5' flat array receiving antenna as described in this invention, peaked at 123° west, no signal was visible from a satellite at 121° west.

The reflective assembly 10 may be made of a lightweight structural material such as metal or metalized plastic. The construction material may also be laminated or otherwise covered in a lightweight reflecting material such as, but not limited to, aluminum foil. The construction material may also be cast or stamped aluminum sheeting or foils, or other reflective materials depending on environment and radiation source.

One possible first step in designing a reflective assembly 10 is to define the dimensions, i.e., the focal length and the depth and diameter of the center reflective surface 12. The values shown in Table 1 may provide a starting point. For example, the depth may be set at 1.59 inches, the diameter at 25.60 inches and the focal length at 25.68 inches, where the reflective surface 12 is centered on 3.9 GHz. The dimensions and parameters of reflective surface 12 may serve as a guide for the dimensions and parameters of all other reflective surfaces (see Equations (4)–(9)).

Figure 7B:
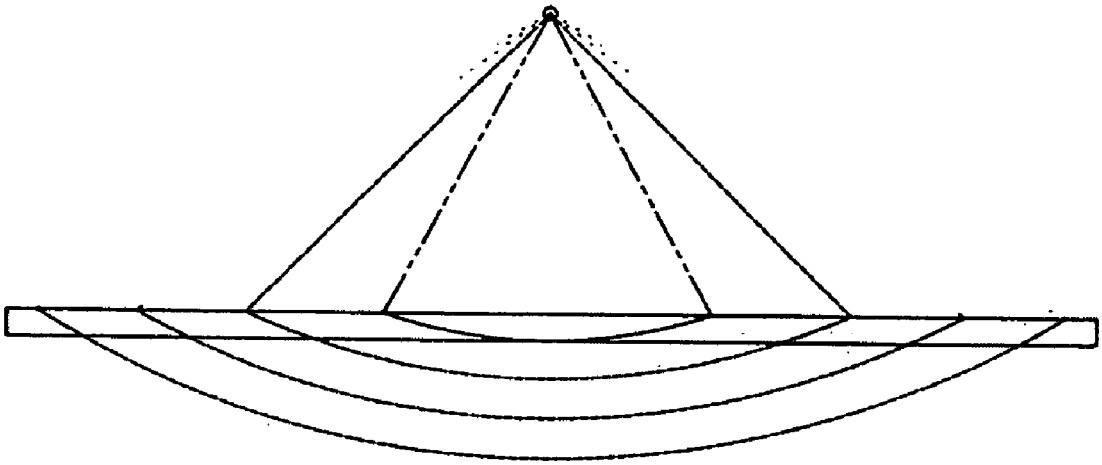

Additionally, one or more of the respective parabolic surfaces 14–24 may be split as discussed above with reference to FIG. 4A–C. The split parabolic surfaces may be configured as desired and formed as a single reflective surfaces using, for example, a metal stamping process. The assembled reflective dish may include one or more reflective surfaces 14–24, which have their bottom surfaces truncated as shown in FIGS. 7A and 7B, and the one or more of the reflective surfaces 14–24 translated about one or more common axes as shown in FIGS. 5A–D and FIGS. 6A and B.

The reflective assembly 10 may also be formed as a unitary structure or as one or more sections that are later assembled. Further, the reflective assembly 10 may also be placed in a support structure of the type described in the Staney patent, the description of which is incorporated herein by reference. One of ordinary skill in the art will appreciate that such a support structure is not necessary to practice the teachings of the present invention.

The reflective assembly 10 may be used in conjunction with a collector (LNB) of the type known and used in the industry. Typical collectors are described in both the Moore and Staney patents, the descriptions of which are incorporated herein by this reference. Commercial collectors may be used with the reflective assembly 10, and a gain may be realized if the focal point spacing does not exceed the width of the collector. The LNB will be placed at the focal length of the reflective assembly. The focal length may be determined using knowledge that is widely known in the industry, and as described in the Moore and Staney patents incorporated herein by reference.

Additionally, commercial scalars and feed horns may be used to collect reflected microwave radiation. For example, such reflected radiation may comprise waves in the C-band and Ku-band. Since the focal points of adjacent rings are at different positions spatially, the scalar design may be modified to enhance signal collection and gain.

The reflective assembly described is primarily used as, but it not limited to, a satellite television receiving antenna. Such antennas are connected to low noise amplifiers. Amplifiers of this type can be driven into saturation or otherwise placed in a limiting mode by short duration high-energy noise bursts. Such noise bursts are merely amplified by the gain of a conventional receiving microwave dish. The present invention on the other hand, controls short duration bursts of noise so that the saturation of the amplifiers to which they are connected is dramatically reduced. While this invention has been described using parabolic surfaces for purposes of illustration, other surfaces such as ellipses, and circles may be utilized with families of surfaces spaced at $n\lambda$, with selected spacing of the focal points to minimize interaction of reflected radiation from adjacent surfaces.

The reflective assembly 10 helps to minimize radiation loss due to the interaction between non-parallel reflected light waves by separating the focal points of adjacent surfaces. Alternatively, radiation loss due to deconstructive interference may be minimized by adjusting the curvature of the adjacent parabolic surfaces by changing the diameter of each surface slightly but maintaining a common focal point throughout the array. Adjusting the diameter of the respective parabolic surfaces comprising the array permits the light waves reflected from any point on any surface of the array to remain in-phase.

Figure 12:
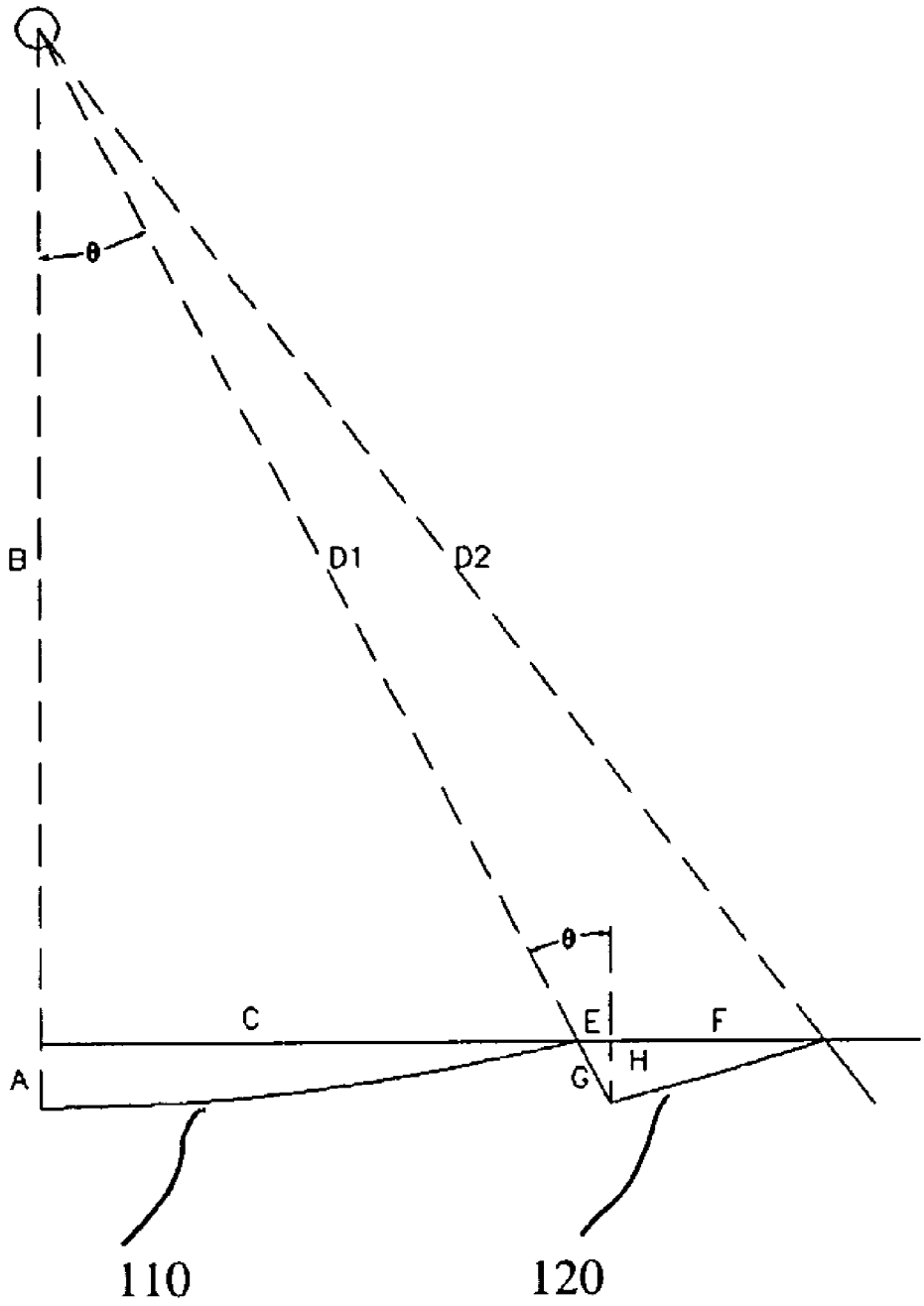
FIG. 12 shows an example of a common focal point reflective array, wherein the incident radiation arrives at the focal point in-phase.
Figure 13A:
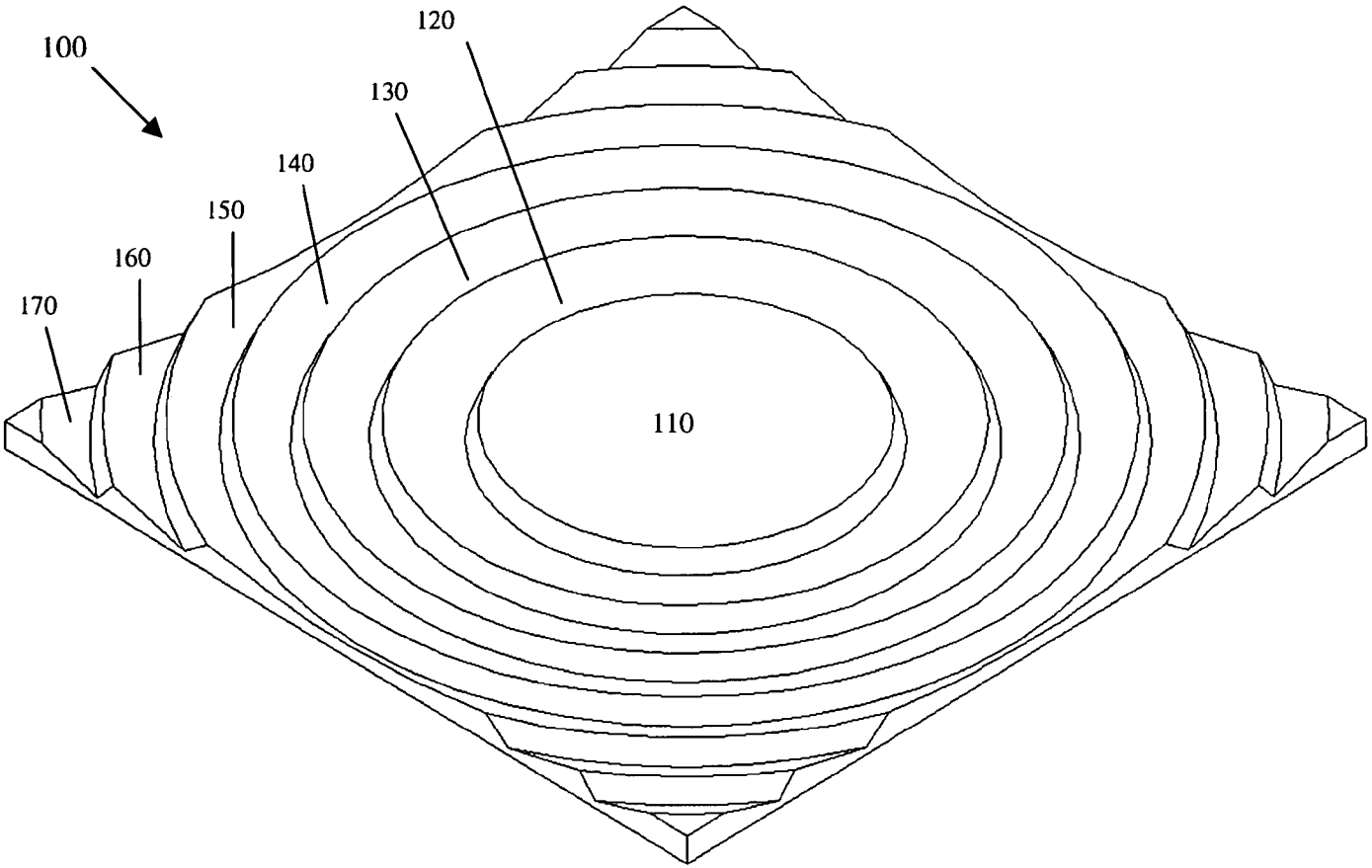
FIGS. 13A–C show an illustrative embodiment of the reflective array shown in FIG. 12 configured with a preferred spacing for maintaining in-phase reflection throughout the entire flat panel array.

FIGS. 12 and 13A illustrate an array 100 having a constant wavelength spacing across the complete surface of the array. The parameters of the first surface 110 drive the parameters of the immediately adjacent surface 120. The following example illustrates one embodiment of the array 100.

EXAMPLE

The array 100 includes a first surface 110 having a radius C of 13 inches, a height B of 24.056 inches, wherein the height represents the focal length of the first surface 110—the distance from the vertex of the first surface 110 to the focal point (fp). As best seen in FIG. 12, the triangle formed by C, B and D1 is a right triangle; the length of D1 is thus 27.344, which may be determined using the Pythagorean theorem. Given the parameters of the first surface 110, the angle theta (θ) shown in FIG. 12 is determined to be 27.675°, which is determined using basic trigonometric functions. Additionally, the depth of the first parabolic surface was set at 1.6 inches (Depth A). This provides a parabola of the form:

$$Y=0.095X^2 \quad (10)$$

To obtain the parameters of the second parabolic surface 120, the hypotenuse D1 is extended below the plane of the first surface 110 a length G. A vertical line (representing incident radiation) crosses line G at some distance E beyond the radius C of first surface 110. Since the incident radiation and the line created by B are parallel, D1 crosses both and produces an angle of intersection equal to theta (θ).

In order for incident radiation from surfaces 110 and 120 to be in-phase by a wavelength spacing of lambda (λ) from D1, the sum of the lengths H+G should equal (λ) spacing. Since H=G * cos(θ), then H+G should equal G+G * cos (θ), which should be set at wavelength spacing (λ) or G(1+cos (θ))=3.2.

At (λ)=3.2 inches, (θ)=27.675°, C=13 inches and a depth (A) of 1.6 inches for first surface 110, G equals 1.70 inches and H should be determined to be 1.50 inches. This corresponds to a length E of 0.79 inches. The necessary length of D2 such that the second reflecting surface 120 is also at (λ)=3.2 inches spacing may be calculated using equation 11:

$$D2=D1+3.2 \quad (11)$$

This occurs only at a length C+F=18.93 inches. Thus, the equation for the second reflective surface becomes:

$$Y=0.008927X^2-3.2 \quad (12)$$

Figure 13B:
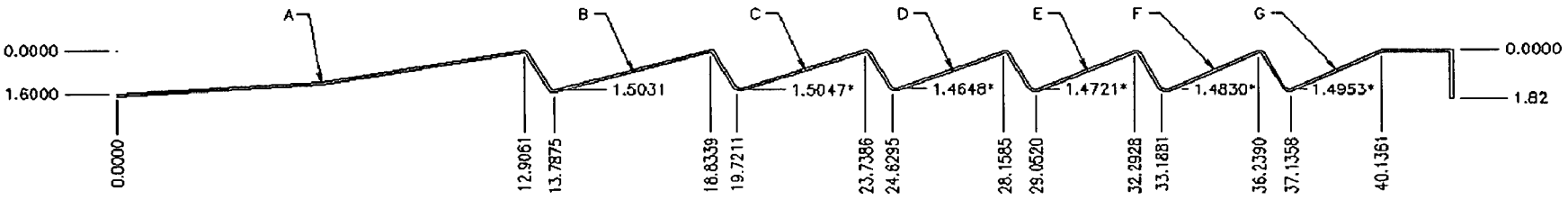
Figure 13C:
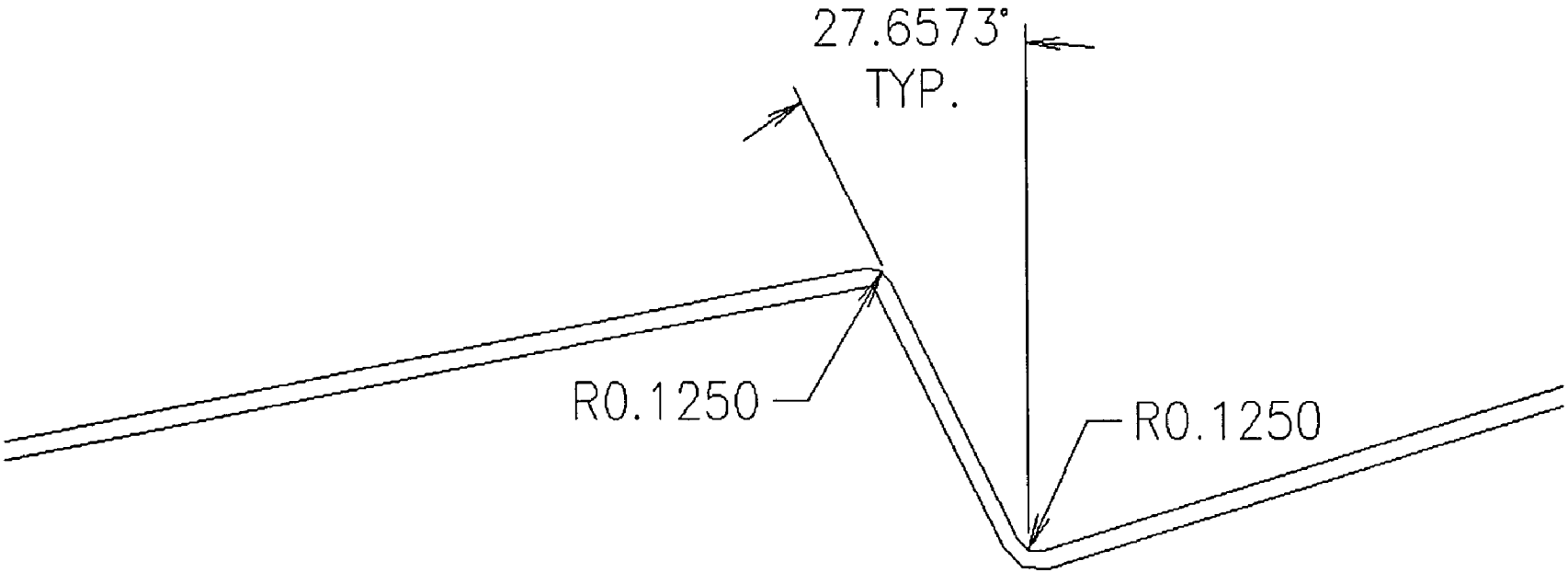

By keeping the vertex at −3.2, but decreasing the slope slightly, the incident radiation reflected by the adjacent surfaces 110, 120 . . . (Sn) are in-phase. FIGS. 13B and 13C illustrate an example of spacing that permits incident radiation from adjacent surfaces to remain in phase.

The principles applied in the above example can be applied to adjacent surfaces to provide more reflecting surfaces. The size of the reflecting surfaces can be scaled by scaling the first surface and recalculating the necessary spacing for the second and subsequent surfaces.

Although a detailed description of the present invention has been disclosed, a person of ordinary skill in the art would realize, however, that certain modifications would come within the teachings of this invention. For example, the reflective assembly has been described as a planar reflective assembly; however, a non-planar construction may be employed by varying the depth, the "J" dimension, throughout the reflective surfaces, resulting in an adjustment of the depth, diameter and/or translation of the reflective surface to maintain desired focal point separation and in-phase radiation. Additionally, the parabolic surfaces have been described as circular, the overall dimension of the parabolic surfaces may be cut to various shapes such as a square, rectangle or any other preferred geometric shape, and signal intensity will remain proportional to the size of the reflective assembly. Therefore, the following claims should be studied to determine the true scope and content of the invention.

What is claimed is:

1. A reflective assembly for use in an antenna for receiving incident microwave signals, comprising:

a first reflective surface; and a plurality of reflective surfaces positioned successively adjacent the first reflective surface, each reflective surface having a focal point and focal length relative to the first reflective surface, wherein one or more of the reflective surfaces are translated about one or more common axes, resulting in an offset of the focal point of one or more of the reflective surfaces relative to that of the first reflective surface, whereby the microwave signals reflected by each reflective surface arrive at the focal point for the particular reflecting surface in-phase with the microwave signals reflected by the other reflective surfaces.

2. The assembly of claim 1 wherein the focal length of each reflective surface differs by lambda or multiples of lambda from the focal length of each directly adjacent reflective surface, where λ is the wavelength.

3. The assembly of claim 1 wherein the upper edges of the first reflective surface and that of the plurality of adjacent reflective surfaces are parallel.

4. The assembly of claim 1 wherein each reflective surface is a parabolic.

5. The assembly of claim 1 wherein each reflective surface is an elliptical curve.

6. The assembly of claim 1 wherein each reflective surface is circular or spherical.

7. The assembly of claim 1 wherein the upper edges of one or more of the reflective surfaces are not parallel.

8. The assembly of claim 1 wherein one or more of the reflective surfaces includes a slope, wherein the slope of one or more reflective surfaces may vary across the cross section of the respective surface.

9. The assembly of claim 1 wherein each reflective surface includes a depth, wherein each reflective surface has a depth adjusted to n (λ) or n(λ/2), where λ is the wavelength.

10. The assembly of claim 1 wherein the focal points of one or more of the respective reflective surfaces are different.

11. The assembly of claim 1 wherein the focal point of the respective reflective surfaces may be adapted to minimize reflected radiation interaction between adjacent reflective surfaces.

12. The assembly of claim 1 wherein the focal point spacing is offset on one or more axes.

13. The assembly of claim 1 wherein the reflective assembly is formed of metal, metalized plastic or a material laminated with a reflecting material.

14. The assembly of claim 13 wherein the reflective assembly is formed of aluminum.

15. The assembly of claim 14 wherein the reflective assembly is formed of stamped or cast aluminum.

16. The assembly of claim 13 the reflective assembly is formed as one or more sections.

17. The assembly of claim 13 wherein the reflective assembly is compact, folded, and shaped to fit the intended use of the application.

18. The assembly of claim 1 wherein the reflective surfaces are formed as one or more sections.

19. A reflective assembly for use in an antenna for receiving incident microwave signals, comprising:

a first reflective surface;

a plurality of reflective surfaces positioned successively adjacent the first reflective surface, wherein each reflective surface is configured to reflect incident radiation in-phase such that microwave signals reflected by each reflective surface arrive at a plurality of focal points in-phase.

* * * * *